US011047198B2

(12) United States Patent
Ross

(10) Patent No.: US 11,047,198 B2
(45) Date of Patent: Jun. 29, 2021

(54) TUBING HANGER ASSEMBLY WITH WELLBORE ACCESS, AND METHOD OF ACCESSING A WELLBORE

(71) Applicant: INNOVEX DOWNHOLE SOLUTIONS, INC., Houston, TX (US)

(72) Inventor: Stephen C. Ross, Odessa, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 0 days.

(21) Appl. No.: 16/707,963

(22) Filed: Dec. 9, 2019

(65) Prior Publication Data

US 2020/0115984 A1 Apr. 16, 2020

Related U.S. Application Data

(63) Continuation of application No. 15/704,762, filed on Sep. 14, 2017, now Pat. No. 10,502,015.
(Continued)

(51) Int. Cl.
*E21B 33/04* (2006.01)
*E21B 33/068* (2006.01)
(Continued)

(52) U.S. Cl.
CPC ..... *E21B 33/0407* (2013.01); *E21B 33/068* (2013.01); *E21B 41/02* (2013.01);
(Continued)

(58) Field of Classification Search
CPC .... E21B 33/0407; E21B 33/068; E21B 47/07; E21B 41/02; E21B 43/128; E21B 43/24; E21B 43/2401; E21B 47/06
See application file for complete search history.

(56) References Cited

U.S. PATENT DOCUMENTS 1,922,024 A 8/1933 Bouslog
3,011,552 A 12/1961 Rhodes et al.
(Continued)

OTHER PUBLICATIONS

B. Blue Hyatt, Letter regarding U.S. Pat. No. 10,502,015 dated May 19, 2020, Lynch, Chappell & Alsup, 5 pages.
(Continued)

*Primary Examiner* — D. Andrews
*Assistant Examiner* — Jonathan Malikasim
(74) *Attorney, Agent, or Firm* — MH2 Technology Law Group LLP

(57) ABSTRACT

A tubing hanger assembly for suspending a tubing string within a wellbore is provided. The tubing hanger assembly comprises a tubing head, a tubing hanger and a tubing head adapter. The tubing hanger and the tubing head adapter have aligned through-openings such that a chemical injection line and a communications line may each be passed through respective through-openings, thereby enabling an operator to have access to the wellbore. Beneficially, the assembly also comprises a bottom flange that secures the tubing head adapter to the tubing head once the tubing hanger and connected string of production tubing are landed in the wellbore. The bottom flange may be rotated so that ports in the bottom flange may be aligned with ports in an upper flange in the tubing head. A method for hanging a string of production tubing in a wellbore is also provided herein.

28 Claims, 10 Drawing Sheets

Related U.S. Application Data

(60) Provisional application No. 62/427,393, filed on Nov. 29, 2016.

(51) Int. Cl.

| | |
|---|---|
| ***E21B 47/07*** | (2012.01) |
| ***E21B 41/02*** | (2006.01) |
| ***E21B 43/12*** | (2006.01) |
| ***E21B 43/24*** | (2006.01) |
| ***E21B 47/06*** | (2012.01) |

(52) U.S. Cl.

CPC ..... *E21B 43/128* (2013.01); *E21B 43/24* (2013.01); *E21B 43/2401* (2013.01); *E21B 47/06* (2013.01); *E21B 47/07* (2020.05)

(56) References Cited

U.S. PATENT DOCUMENTS

| | | | | |
|---|---|---|---|---|
| 3,494,638 | A | | 2/1970 | Todd et al. |
| 4,171,018 | A | | 10/1979 | Walker |
| 4,202,410 | A | | 5/1980 | Quebe |
| 4,278,278 | A | | 7/1981 | Chambless et al. |
| 4,627,489 | A | | 12/1986 | Reed |
| 4,693,534 | A | * | 9/1987 | Clark ..... H01R 13/533 439/275 |
| 5,103,900 | A | | 4/1992 | McLeod et al. |
| 5,667,008 | A | | 9/1997 | Moore |
| 6,145,597 | A | | 11/2000 | Kobylinski |
| 6,202,743 | B1 | | 3/2001 | Moore |
| 6,516,887 | B2 | | 2/2003 | Nguyen et al. |
| 6,530,433 | B2 | | 3/2003 | Smith |
| 6,688,386 | B2 | | 2/2004 | Cornelssen et al. |
| 7,552,762 | B2 | | 6/2009 | Khazanovich et al. |
| 7,913,754 | B2 | | 3/2011 | Bolding |
| 9,441,441 | B1 | | 9/2016 | Hickie |
| 10,502,015 | B2 | * | 12/2019 | Ross ..... E21B 33/0407 |
| 2004/0079532 | A1 | | 4/2004 | Allen |
| 2005/0263293 | A1 | | 12/2005 | Tessier et al. |
| 2012/0012335 | A1 | | 1/2012 | White et al. |
| 2014/0151069 | A1 | | 6/2014 | Kajaria et al. |
| 2016/0076329 | A1 | | 3/2016 | Nguyen et al. |
| 2019/0218878 | A1 | | 7/2019 | Sneed |

OTHER PUBLICATIONS

Non-Final Office Action dated Jun. 19, 2020, U.S. Appl. No. 16/875,112, 51 pages.

Non-Final Office Action dated Jan. 27, 2021, U.S. Appl. No. 16/875,112, 13 pages.

* cited by examiner

TUBING HANGER ASSEMBLY WITH WELLBORE ACCESS, AND METHOD OF ACCESSING A WELLBORE

CROSS REFERENCE TO RELATED APPLICATIONS

This application claims the benefit of U.S. Ser. No. 62/427,393 filed Nov. 29, 2016. That application is entitled "Tubing Hanger Assembly With Wellbore Access, and Method of Accessing a Wellbore," and is incorporated herein in its entirety by reference. The present application is a divisional of U.S. patent application Ser. No. 15/704,762 filed Sep. 14, 2017, and issued as U.S. Pat. No. 10,502,01 on Dec. 9, 2019, which is incorporated herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of hydrocarbon recovery operations. More specifically, the present invention relates to a system for hanging a string of production tubing in a wellbore, while allowing an operator access to the wellbore from the surface. The invention also relates to a method of accessing a wellbore through a tubing hanger assembly using a novel adapter.

Technology in the Field of the Invention

In the drilling of oil and gas wells, a wellbore is formed using a drill bit that is urged downwardly at a lower end of a drill string. The drill bit is rotated while force is applied through the drill string and against the rock face of the formation being drilled. After drilling to a predetermined depth, the drill string and bit are removed and the wellbore is lined with a string of casing.

It is common to place several strings of casing having progressively smaller outer diameters into the wellbore. In this respect, the process of drilling and then cementing progressively smaller strings of casing is repeated several times until the well has reached total depth. The final string of casing, referred to as a production casing, is typically cemented into place.

As part of the completion process, the production casing is perforated at a desired level. Alternatively, a sand screen may be employed at a lowest depth in the event of an open hole completion. Either option provides fluid communication between the wellbore and a selected zone in a formation. In addition, production equipment such as a string of production tubing, a packer and a pump may be installed within the wellbore.

During completion, a wellhead is installed at the surface. Fluid gathering and processing equipment such as pipes, valves and separators are also provided. Production operations may then commence.

In typical land-based production operations, the wellhead includes a tubing head and a tubing hanger. The tubing head seals the wellbore at the surface while the tubing hanger serves to gravitationally support the long string of production tubing. The tubing string extends down from the tubing hanger proximate to a first pay zone.

During the production process, the production tubing may experience thermal expansion over time. This is due to the presence of warm production fluids being produced up through the pipe and to the surface. To offset the anticipated expansion, it is known to place the production tubing under some degree of tension when the well is completed. This will maintain the production tubing in a linear state even while the pipe string relaxes in response to thermal expansion. Thus, even when the production tubing expands over time, the tubing does not buckle within the wellbore. This is of particular benefit when the wellbore is being rod pumped, as pre-tensioning minimizes frictional contact between the rod string and the surrounding production tubing during pumping.

In connection with hanging the tubing in the wellbore, it is sometimes desirable to run an electric line to provide power to a resistive heater or to an electric submersible pump (or "ESP") downhole. U.S. Pat. No. 6,688,386 entitled "Tubing Hanger and Adapter Assembly" provides one wellhead arrangement for running a power cable at the surface through a tubing hanger system. Such a wellhead arrangement uses an adapter above the tubing head to accommodate and to isolate the electric line. However, this and other known wellhead assemblies have limitations concerning the alignment of ports drilled in the adapter with through-openings located in the top flange of the tubing head.

In connection with hanging the tubing in the wellbore, it is further desirable to provide a fluid supply line into the well. However, existing tubing tensioning arrangements generally prevent the use of the somewhat non-ductile fluid supply line that will descend through and below the tubing hanger. Moreover, known tubing hangers generally require that the tubing string be rotated or turned five or more times in connection with setting the tubing anchor downhole and locking the tubing hanger at the surface. Typical stainless steel chemical injection lines cannot tolerate the stress and tension induced by the produced torque, nor can they be "snaked" through access ports that are not perfectly aligned.

Accordingly, a need exists for a tubing hanger assembly that enables hanging tubing from a tubing head at the surface with less than one complete rotation of the production string during hanging. Further, a need exists for an improved tubing hanging system that is able to accommodate a chemical injection line without twisting the metal line as it enters the wellhead and travels downhole. Still further, a need exists for an adapter that is part of the wellhead that enables a communications line to be run through the tubing hanger and down the wellbore, and that connects to survey equipment downhole.

SUMMARY OF THE INVENTION

A tubing hanger assembly for suspending a tubing string within a wellbore is provided herein. Beneficially, the tubing hanger assembly provides a rotating flange that freely rotates relative to a tubing head in order to eliminate alignment issues with connection ports during installation.

The tubing hanger assembly first includes a tubing head. The tubing head resides over the wellbore and seals the wellbore in order to isolate wellbore fluids. The tubing head defines a cylindrical bore that is configured to receive the tubing string. The tubing head is configured to land over a wellbore and to help seal the wellbore at the surface during production operations.

The tubing hanger system also includes a tubing hanger. The tubing hanger defines a cylindrical body having an upper end and a lower end. The lower end includes female threads for making a threaded connection with an uppermost joint of the tubing string.

The tubing hanger is configured to reside within the cylindrical bore of the tubing head over the wellbore. In this way, the tubing hanger gravitationally supports the tubing string. In one aspect, a beveled surface along an outer diameter of the tubing hanger lands on a matching conical shoulder along an inner diameter of the tubing head. This is referred to as a "landed" position and seals by means of elastomers (or "o-rings").

Preferably, the tubing string is connected to a tubing anchor within the wellbore such that the tubing string is maintained in tension. Preferably, the tubing hanger and the tubing anchor are each configured to be set through a rotation of the tubing string that is less than one full rotation. This avoids placing a chemical injection line running down the tubing string under torque.

In one embodiment of the current invention, the cylindrical body of the tubing hanger comprises at least one, and preferably two, elongated through-openings. The through-openings extend from a bottom end of the cylindrical body, up to a top end. An inner diameter of a first through-opening may be dimensioned to receive a chemical injection line, while an inner diameter of a second through-opening may be dimensioned to receive a separate communications line. The communications line may be an electric line, a power line or a fiber optic cable.

The tubing hanger system further includes a tubing hanger adapter. The tubing hanger adapter resides over the tubing head. The tubing hanger adapter also defines a cylindrical body having a bore, wherein the cylindrical bore of the tubing head adapter is in alignment with the cylindrical bore of the tubing head when the tubing head adapter is installed.

The body of the tubing head adapter also contains at least one elongated through opening that runs generally from the lower end to the upper end of the tubing head adapter. These through openings are referred to as auxiliary holes. A first auxiliary hole has an inner diameter that matches the inner diameter of the first through-opening in the tubing hanger, while a second auxiliary hole has an inner diameter that matches the inner diameter of the second through-opening in the tubing hanger. In addition, the auxiliary holes are positioned within the cylindrical body of the tubing head adapter to align with (or to be alignable with) the respective through-openings in the cylindrical body of the tubing hanger.

Using the first auxiliary hole, the chemical injection line passes through the tubing head adapter and the body of the tubing hanger, and then runs along the tubing string to a designated depth within the wellbore. Similarly, using the second auxiliary hole, the communications line passes through the tubing head adapter and the body of the tubing hanger. The communications line then runs along the tubing string to a designated depth within the wellbore, and connects to one or more sensors. Preferably, the chemical injection line and the communications line are clamped to selected joints of the tubing string.

The tubing hanger system may further include a bottom rotating flange. The bottom rotating flange defines a cylindrical body having a plurality of ports formed there through. Preferably, 8 to 12 ports are equi-distantly spaced around the body. The bottom rotating flange includes a beveled surface along an inner diameter. The beveled inner surface is dimensioned to land on a matching conical surface that resides along an outer diameter of the tubing head adapter. More specifically, the conical surface resides along a top flange of the tubing head.

Beneficially, the bottom rotating flange rotates along the matching conical shoulder along the outer diameter of the tubing head's top flange. This means that the matching conical shoulder serves as a bearing surface. In this way, ports drilled in the bottom rotating flange may be rotated to align with ports located along an upper shoulder of the tubing head. Threaded connectors may then be placed through the aligned ports and tightened to create a sealed connection between the tubing head adapter and the tubing head.

During completion, the chemical injection line passes through the first auxiliary hole of the tubing head adapter, and then passes through the aligned through-opening of the tubing hanger. The chemical injection line continues down hole to a depth proximate a pump. Similarly, the communications line passes through the second auxiliary hole of the tubing head adapter, and then passes through the aligned through-opening in the tubing hanger. The communications line continues down hole to a designated depth.

The communications line has a connected sensor such as a temperature sensor or a pressure sensor. The communications line may be an electric line or a fiber optic cable. In one aspect, the communications line is a power cable that provides power to a downhole resistive heater element or to an ESP.

A method for accessing a wellbore is also provided herein. The method involves securing a tubing head to a casing string above the wellbore. The tubing head defines a cylindrical body having an elongated through-opening, forming a bore.

Next, a tubing string is lowered through the bore of the tubing head, joint-by-joint, and into the wellbore. The tubing string defines a series of tubing joints having threaded connections. A tubing hanger is then threadedly connected to an upper tubing joint.

The method next provides landing the tubing hanger onto the tubing head. As noted above, the tubing hanger is configured to reside within the cylindrical bore of the tubing head over the wellbore. In this way, the tubing hanger gravitationally supports the tubing string. A conical surface along an outer diameter of the tubing hanger lands on a matching conical shoulder along an inner diameter of the tubing head to place the tubing hanger in its landed position.

In one aspect, the method also provides for running both a chemical injection line and a communications line into the wellbore. Preferably, both the chemical injection line and the communications line are clamped to the production tubing, joint-by-joint, as the production tubing is run into the wellbore. Preferably, the method also includes securing at least one downhole sensor to a bottom end of the communications line before the communications line is run into the wellbore.

The method also includes providing a tubing head adapter. The tubing head adapter also defines a cylindrical body having a bore. The cylindrical body contains at least one elongated through-opening that runs generally from the lower end to the upper end. The through openings are again referred to as auxiliary holes. The method then includes aligning the auxiliary holes with matching through-openings residing along the body of the tubing hanger.

In one aspect, a first auxiliary hole is dimensioned to receive an upper end of the chemical injection line. The chemical injection lines runs through the tubing hanger body, then through the tubing hanger, and then along the tubing string to a designated depth within the wellbore. The designated depth is preferably at or just below the pump. A second auxiliary hole is dimensioned to receive an upper end of the communications line. The communications line also runs through the tubing hanger body, then through the tubing hanger, and is clamped to the tubing string. The communications line is connected to a sensor such as a temperature sensor or a pressure sensor. The communications line may be an electric line or a fiber optic cable.

In another embodiment, a third auxiliary hole is dimensioned to receive a power cable. The power cable provides power to a downhole resistive heater element or to an ESP.

The method may further include placing a rotating bottom flange onto an outer diameter of the body of the tubing head adapter. The bottom flange is then rotated in order to align ports residing in the bottom flange with ports residing in a top flange of the tubing head. Threaded connectors are then run through the aligned ports and are tightened in order to secure the tubing head adapter to the tubing head itself.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
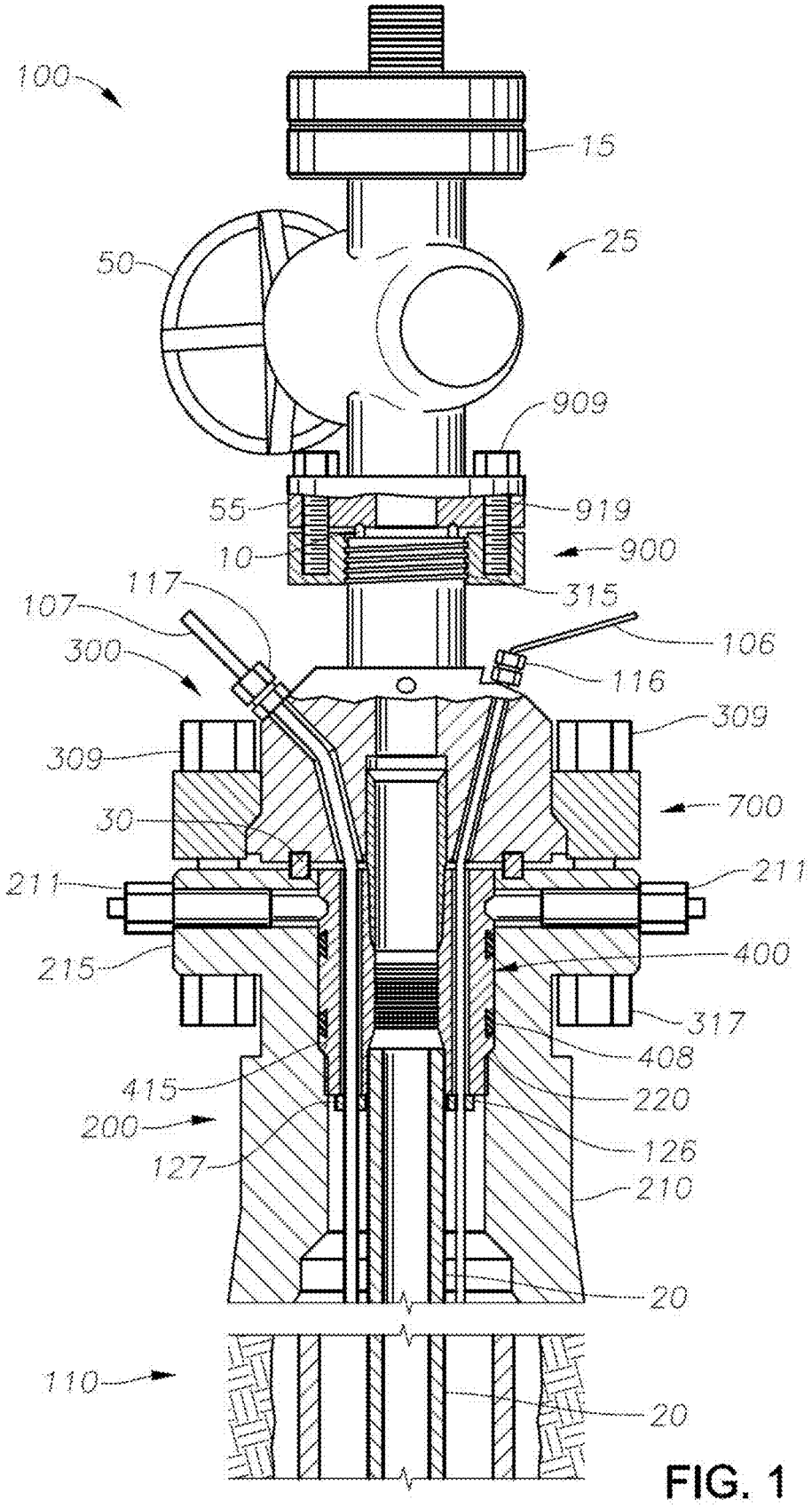
FIG. 1 is a cut-away view of a tubing head assembly for supporting a string of production tubing from the surface. The tubing head assembly includes a tubing head, a tubing hanger and a tubing head adapter.

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient condition. Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, oxygen, carbon dioxide, hydrogen sulfide and water.

As used herein, the term "fluid" refers to gases, liquids, and combinations of gases and liquids, as well as to combinations of gases and solids, combinations of liquids and wellbore fines, and combinations of gases, liquids, and fines.

As used herein, the term "wellbore fluids" means water, hydrocarbon fluids, formation fluids, or any other fluids that may be within a wellbore during a production operation.

As used herein, the term "gas" refers to a fluid that is in its vapor phase.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface.

As used herein, the term "communication line" or "communications line" refers to any line capable of transmitting signals or data. The term also refers to any insulated line capable of carrying an electrical current, such as for power.

As used herein, the term "wellbore" refers to a hole in the subsurface made by drilling or insertion of a conduit into the subsurface. A wellbore may have a substantially circular cross section, or other cross-sectional shapes. The term "well," when referring to an opening in the formation, may be used interchangeably with the term "wellbore." When used in connection with a drilling process, the term "bore" refers to the diametric opening formed in the subsurface through the drilling process.

Description of Selected Specific Embodiments

A tubing hanger assembly is provided herein. The tubing hanger assembly enables a string of production tubing to be hung from a wellhead at the surface. At the same time, the assembly enables access to the wellbore below the tubing head from the surface. Access means that one or more chemical injection lines and/or one or more communications lines may be run through the tubing head en route to the wellbore.

FIG. 1 is a cut-away view of a tubing hanger assembly 100 for supporting a string of production tubing 20. The tubing hanger assembly 100 is designed to reside at a surface. The surface may be a land surface; alternatively, the surface may be an ocean bottom or a lake bottom, or a production platform offshore. The tubing hanger system 100 is designed to be part of a larger wellhead (not shown, but well-familiar to those of ordinary skill in the art) used to control and direct production fluids from the wellbore and to enable access to the "back side" of the tubing string 20.

The tubing hanger assembly 100 includes a tubing head 200, a tubing head adapter 300, and a tubing hanger 400. The illustrative tubing hanger assembly 100 also includes a rotating flange 700, referred to herein at times as a "bottom rotating flange.". The bottom rotating flange 700 is used to secure the tubing head adapter 300 to the tubing head 200.

Figure 2:
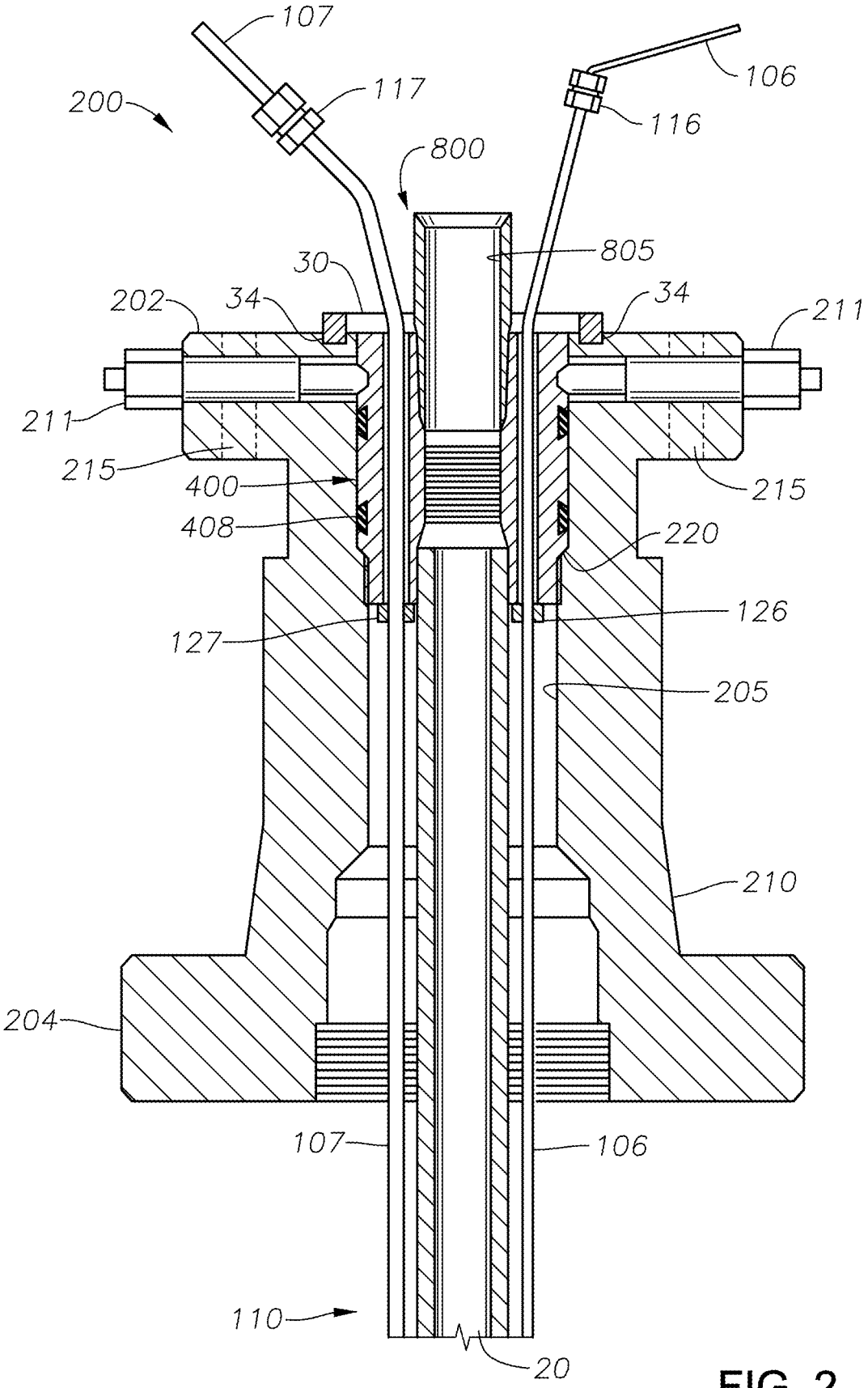
FIG. 2 is a cut-away view of the tubing head of FIG. 1, without the tubing head adapter. The tubing head has received a tubing hanger, with the tubing hanger being in its landed position, supporting a string of production tubing.

FIG. 2 is a cut-away view of the full tubing head 200 of FIG. 1. Here, the tubing head adapter 300 has been removed for illustrative purposes. The tubing head 200 has received a tubing hanger 400, with the tubing hanger being in its landed position along an inner bore 205 of the tubing head 200. A string of production tubing 20 is shown extending down from the tubing hanger 400.

The tubing head 200 resides over a wellbore 110. The tubing head 200 serves to seal the wellbore 110 and to isolate wellbore fluids at the surface. The tubing head 200 defines a cylindrical body 210 that is configured to closely receive the tubing string 20. The tubing head 200 has an upper (or top) flange 202 and a lower (or bottom) flange 204. As will be described in further detail below, the top flange 202 is configured to receive a tubing head adapter 300 using threaded connectors 309 having threads (seen at 319 in FIG. 3). Nuts 317 threadedly fasten onto the threads 319 to tighten the tubing head adapter 300. Preferably, the upper flange offers a plurality of openings (seen in FIG. 2 at 215) to receive respective connectors 309. The bottom flange 204 is configured to cover the wellbore 110.

Figure 3:
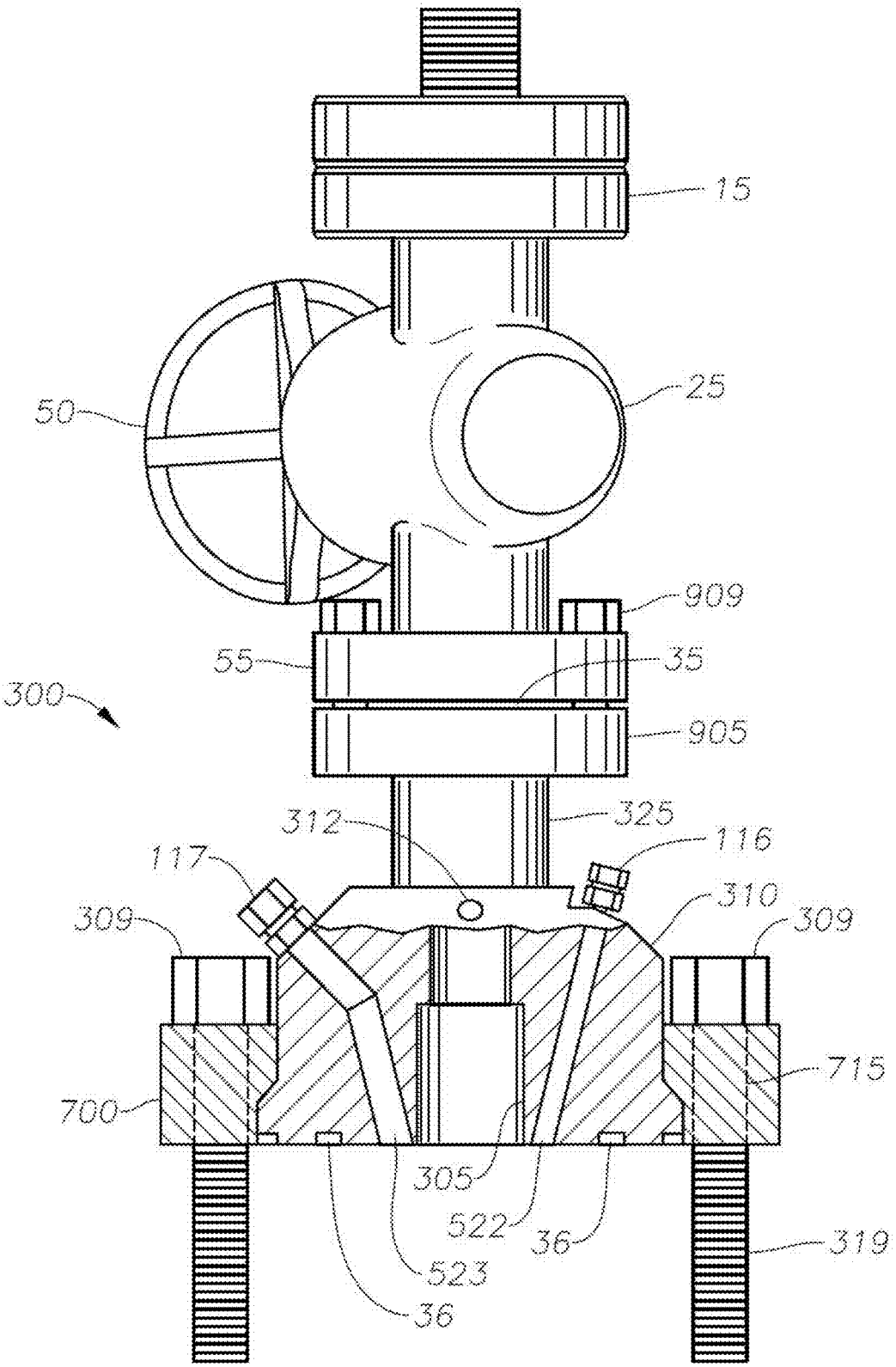
FIG. 3 is a side view of a portion of a well head wherein the tubing head assembly of FIG. 1 is installed. The tubing head adapter and a rotating flange for the adapter are shown installed below the well head. The adapter is configured to be secured onto a top of the tubing head of FIG. 1.

As noted, the tubing hanger system 100 also includes a tubing head adapter 300. FIG. 3 is a side view of a portion of a well head, showing the tubing head adapter 300. The bottom rotating flange 700 is also shown in FIG. 3.

The tubing head adapter 300 is designed to reside over the tubing head 200. More specifically, the adapter 300 is configured to be secured onto the top flange 202 of the tubing head 200 by means of the threaded connectors 309. The threaded connectors 309 are placed through openings 715 (shown in FIG. 3) in the bottom rotating flange 700, and then through aligned openings 215 in the top flange 202 of the tubing head 200.

Figure 5A:
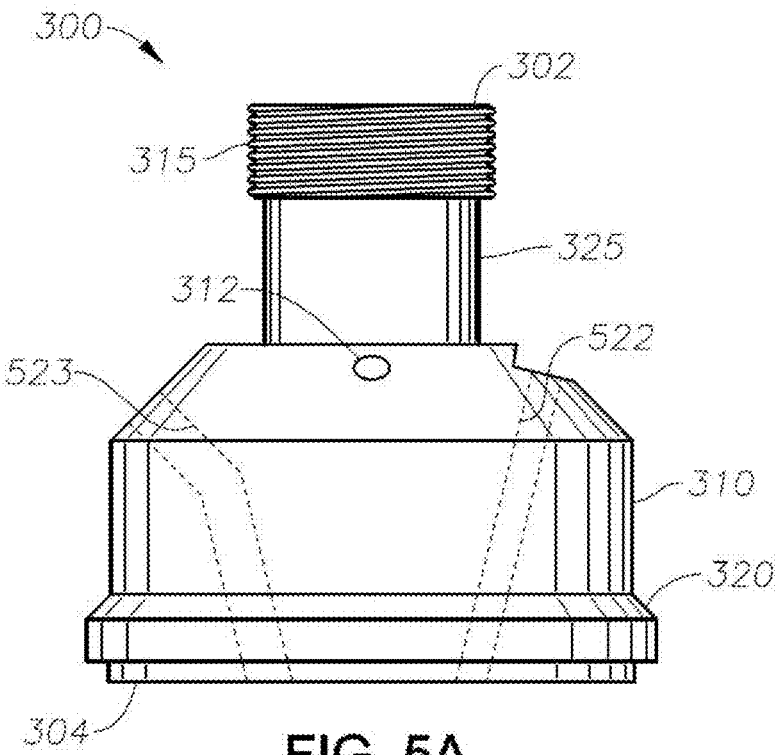
FIG. 5A is a first side view of a tubing head adapter of the present invention, in one embodiment. The tubing head adapter includes a pair of illustrative auxiliary holes machined through a body (holes shown in FIG. 6).
Figure 5B:
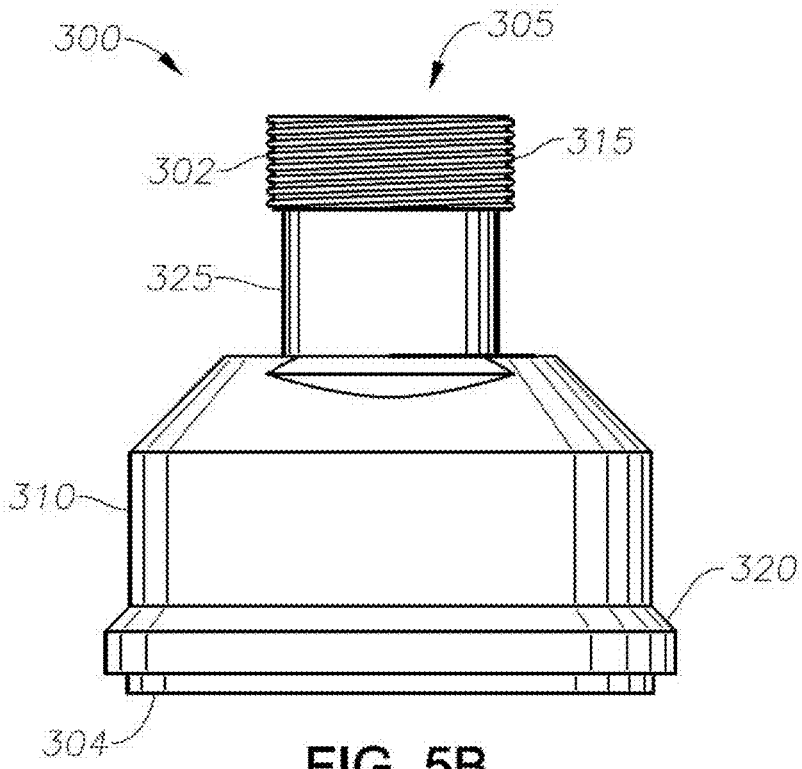
FIG. 5B is a second side view of the tubing head adapter of FIG. 5A, wherein the tubing head adapter has been rotated 90° clockwise relative to the view of FIG. 5A.

The tubing head adapter 300 also defines a cylindrical body (shown best at 310 in FIGS. 5A and 5B). The body 310 defines a bore (shown at 305 in FIGS. 5C and 6). The cylindrical bore 305 of the tubing head adapter 300 is in parallel alignment with the cylindrical bore 205 of the tubing head 200 when the tubing head adapter 300 is installed. Additional details concerning the tubing head adapter 300 are described in connection with FIGS. 5A, 5B, 5C and 6, below.

Figure 4A:
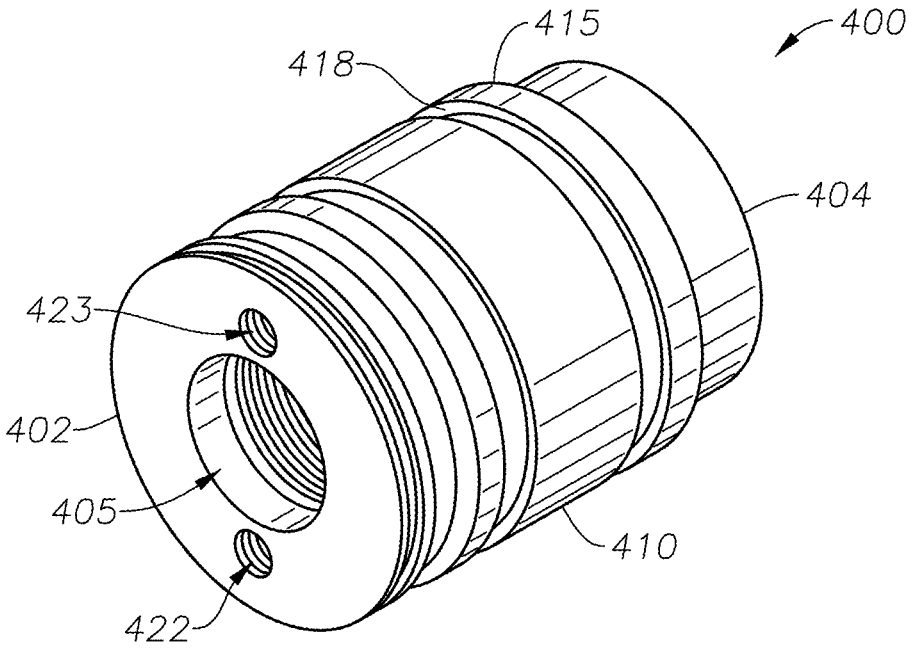
FIG. 4A is a perspective view of a tubing hanger of the tubing hanger system of FIG. 1, in one embodiment.

As noted, the tubing hanger system 100 also includes a tubing hanger 400. FIG. 4A is a perspective view of a tubing hanger 400 of the tubing hanger assembly 100 of FIG. 1, in one embodiment. The tubing hanger 400 defines a cylindrical body 410, having an upper end 402 and a lower end 404. The lower end 404 includes female threads for making a threaded connection with an upper joint of the tubing string 20. Those of ordinary skill in the art will know that the upper end of a joint of tubing string is referred to as the "pin end."

Figure 4B:
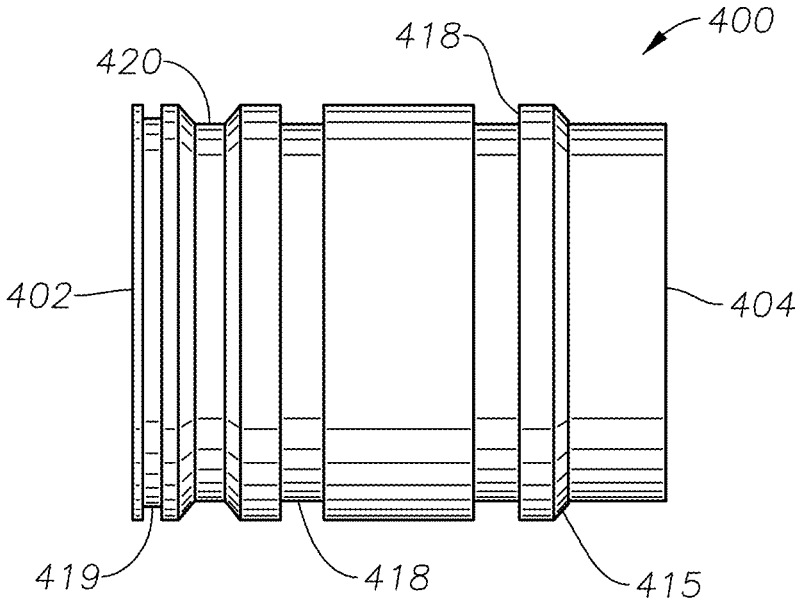
FIG. 4B is a side view of the tubing hanger of FIG. 4A.
Figure 4C:
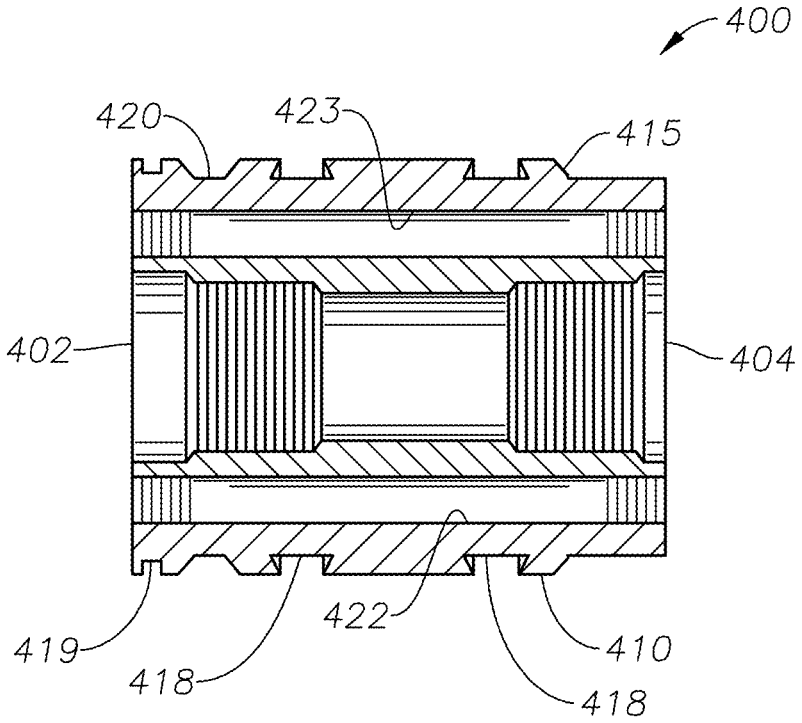
FIG. 4C is a cross-sectional view of the tubing hanger of FIG. 4A.
Figure 4D:
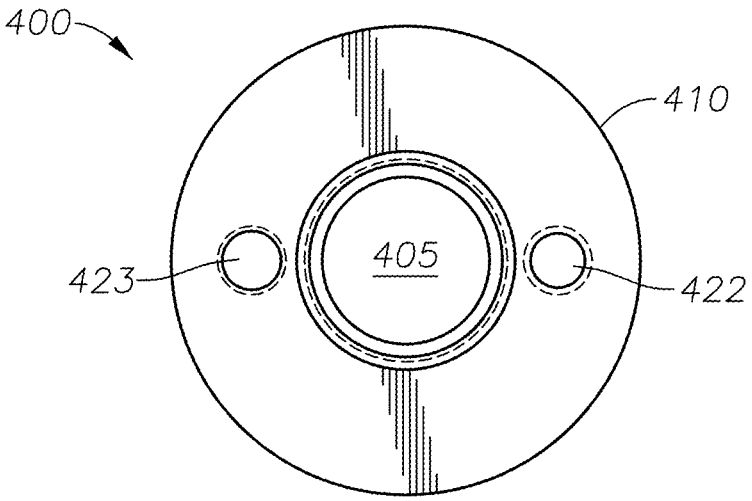
FIG. 4D is an end view of the tubing hanger of FIG. 4A, taken from a bottom end.

FIG. 4B is a side view of the tubing hanger 400 of FIG. 4A. FIG. 4C is a cross-sectional view of the tubing hanger 400 of FIG. 4A. It can be seen that the tubing hanger 400 is essentially a male-to-male threaded connector sub. FIG. 4D is an end view of the tubing hanger 400, taken from a bottom end 404. A bore 405 runs from the bottom end 404 up to the top end 402.

The tubing hanger 400 is configured to reside within the bore of the tubing head 200 over the wellbore 110. In this way, the tubing hanger 400 gravitationally supports the tubing string 20. The bore 405 of the tubing hanger 400 is aligned with the production tubing 20. In one aspect, a beveled surface 415 along an outer diameter of the body 410 lands on a matching conical surface 220 (shown in FIG. 2) along an inner diameter of the tubing head 200. This provides a metal-to-metal seal, referred to as a landed (or "resting") position.

The tubing hanger 400 includes two lower recessed portions 418. These recessed portions 418 are configured to receive "o-rings" (seen in FIG. 1 at 408). The o-rings 408 provide a seal between the tubing hanger 400 and the surrounding tubing head 200 below lock pins 211. The tubing hanger 400 also includes an upper recessed portion 419. Recessed portion 419 is configured to receive and optional o-ring (not shown) above the lock pins 211.

The lock pins 211 are seen in FIGS. 1 and 2. The lock pins 211 reside on opposing sides of the tubing head 200. The lock pins 211 help secure the tubing string 20 in place, meaning they prevent relative rotation of the tubing string 20 within the tubing head 200. The opposing pins 211 are tightened into the tubing head 200 and lock into the tubing hanger 400 which supports the tubing string 20. As the pins 211 are tightened within the upper flange 202 of the tubing head 200, the pins 211 engage a central recessed outer diameter portion 420 of the tubing hanger 400.

As noted, the tubing hanger 400 supports a tubing string 20. Preferably, the tubing string 20 is connected to a tubing anchor (not shown) within the wellbore 110. In this way, the tubing string 20 may be maintained in tension. It is understood by those of ordinary skill in the art that by suspending the tubing string 20 from the surface, at least an upper portion of the tubing string 20 will reside in a state of tension. However, in long strings of jointed tubing when a reciprocating pump is used, the portion of the tubing string 20 closest to the tubing anchor will rest on the anchored pump barrel, causing at least the lower portion of the tubing string 20 to go into compression. This, in turn, causes buckling which causes premature wear of the rods and tubing. Accordingly, operators will pull the tubing string 20 into slight tension before "hanging," and then lock the tubing string 20 into place using the tubing hanger 400.

Preferably, the tubing hanger 400 and/or the tubing anchor (not shown) are each configured to be set through a rotation of the tubing string that is less than one full rotation. This avoids placing a chemical injection line running down the tubing string 20 under stress. For a description of this technology, U.S. Ser. No. 15/643,202 filed Jul. 6, 2017 and entitled "Tubing Hanger System, and Method of Tensioning a Production Tubing in a Wellbore" is referred to and is incorporated herein by reference in its entirety. This application is co-owned by Applicant herein.

In one embodiment of the current invention, the cylindrical body 410 of the tubing hanger 400 comprises at least one, and preferably two, elongated through-openings 422, 423. These are seen best in FIGS. 2 and 4C. The through-openings 422, 423 extend from the top end 402 of the cylindrical body 410, down to the bottom end 404. An inner diameter of a first through-opening 422 may be dimensioned to receive a chemical injection line (seen best in FIG. 2 at 106), while an inner diameter of a second through-opening 423 may be dimensioned to receive a communications line (seen best in FIG. 2 at 107).

The chemical injection line 106 is preferably a small-diameter (such as ¼"), stainless steel tubing. The chemical injection line 106 is used to inject chemicals such as steam, corrosion inhibitors, foam and water. The injection line 106 extends down into the wellbore 110 and terminates at a pump inlet (not shown). In this way, treating fluid is delivered proximate a reciprocating pump (not shown) below the anchor to treat the pump hardware.

The communications line 107 may be an electric data line or a fiber optic cable. The communications line 107 likewise extends down into the wellbore 110 to a designated depth. One or more sensors (not shown) are connected to the communications line 107 proximate a bottom end. The sensors may sense, for example, down hole temperature, pressure or fluid density. Sensor readings may be transmitted up the communications line 107 where they may be stored in memory at the surface. More preferably, sensor readings are transmitted at the surface to a remote processor for storage and analysis.

Figure 5C:
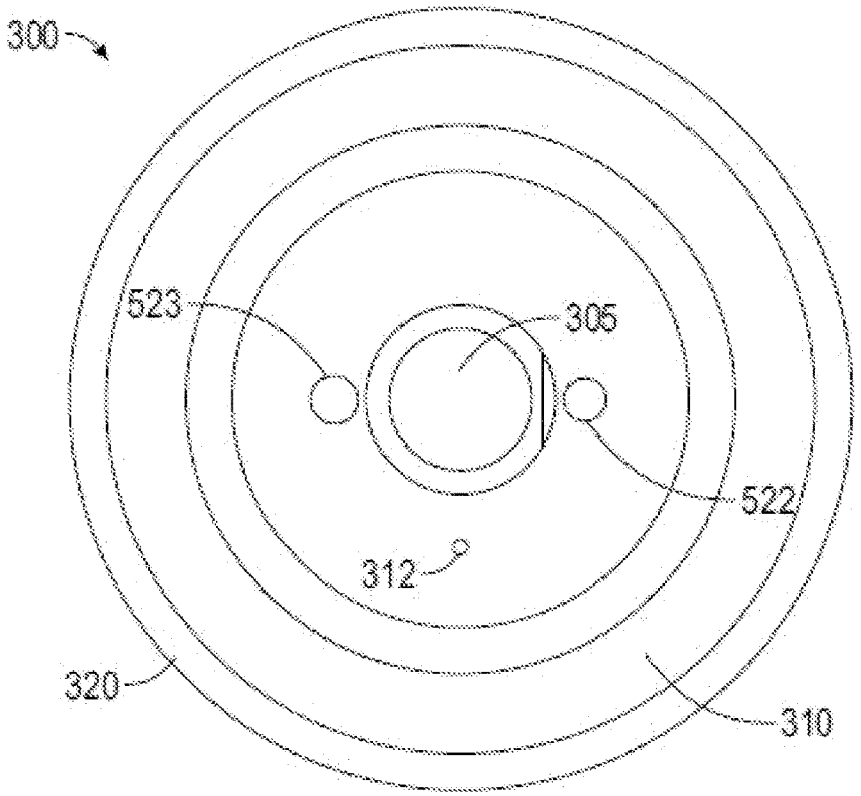
FIG. 5C is a bottom view of the tubing head adapter of FIGS. 5A and 5B.

In order to facilitate routing the chemical injection line 106 and the communications line 107 from the surface, the tubing head adapter 300 is provided. Features of the tubing head adapter 300 are better seen in FIGS. 5A, 5B and 5C. FIG. 5A is a first side view of the tubing head adapter 300 of the present invention, in one embodiment. FIG. 5B is a second side view of the tubing head adapter 300 of FIG. 5A, taken from a side opposite the first side view. In FIG. 5B, the tubing head adapter 300 has been rotated 90-degrees clockwise relative to the view of FIG. 5A. FIG. 5C is a bottom view of the tubing head adapter 300 of FIGS. 5A and 5B.

It can be seen that the tubing head adapter 300 again includes a somewhat cylindrical and somewhat bell-shaped body 310. The body 310 of the tubing head adapter 300 also contains at least one elongated through opening that runs generally from the upper end 302 down to the lower end 304. These through openings are referred to as auxiliary holes. Auxiliary holes 522, 523 are best seen in FIGS. 3, 5A and 5C.

The upper end 302 of the tubing head adapter 300 defines a cylindrical neck 325. The cylindrical neck 325 is configured to threadedly receive a spin-on flange (shown in FIG. 9A at 900. Male Acme threads 315 receive female threads within a bore 905 of the flange 900 to secure a lower flange 55 and connected valve 25.

A first auxiliary hole 522 has an inner diameter that matches the inner diameter of the first through-opening 422 in the tubing hanger 400. At the same time, a second auxiliary hole 523 has an inner diameter that matches the inner diameter of the second through-opening 423 in the tubing hanger 400.

Figure 6:
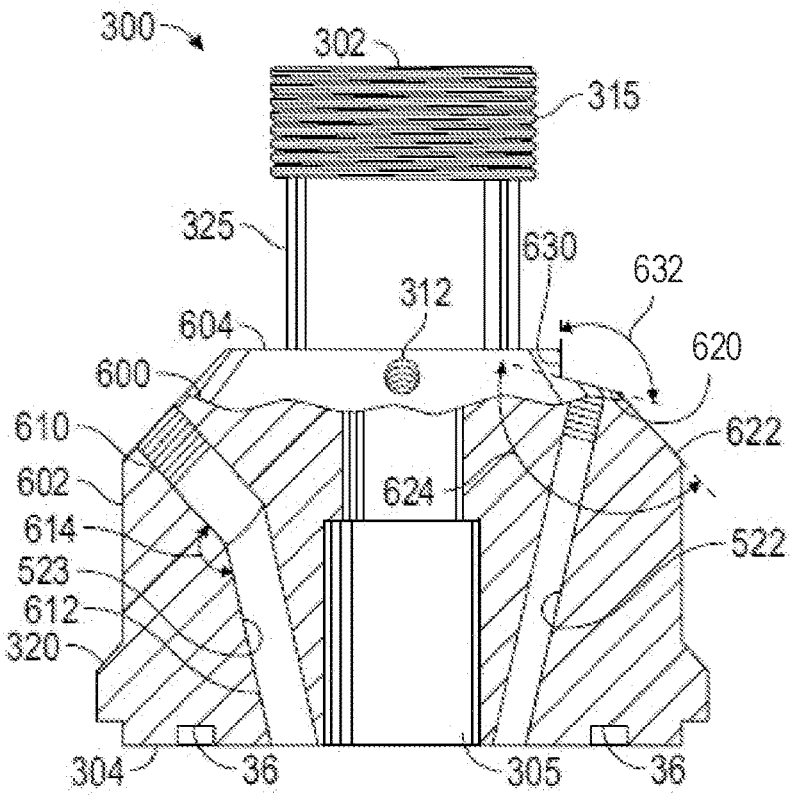
FIG. 6 is a cut-away view of the tubing head adapter of FIGS. 5A and 5B. First and second auxiliary holes are visible.

FIG. 6 is a cut-away view of the tubing head adapter 300 of FIGS. 3, 5A and 5B. Here the auxiliary hole 522 for the chemical injection line 106 and the auxiliary hole 523 for the communications line/electrical wires 107 are more clearly seen. In addition, a central bore 305 of the tubing head adapter 300 is visible.

It is again observed that the tubing head adapter 300 defines a generally cylindrical body 310. A top end 302 of the body 310 defines a connector having threads 315, while a bottom end 304 of the body 310 is flanged outward. The body 310 includes a conical surface 320 configured to receive a beveled surface (seen at 720 in FIG. 7A) of a bottom flange 700.

As noted, the tubing head adapter 300 includes a pair of auxiliary holes 522, 523 machined there through. The auxiliary holes 522, 523 are shown in phantom in FIG. 5A. However, the auxiliary holes 522, 523 are better seen in FIG. 6.

Also visible in FIG. 6 is a test port 312. The test port 312 allows an operator or a regulatory agency to test whether the tubing hanger system 100 is able to hold pressure after the system 100 is completely assembled.

It is understood that during well completion, sections of production tubing 20 in the form of joints are run into the wellbore 110. The ¼" tubing 106 and the communications line 107 are banded to the tubing joints until the production tubing 20 reaches a specific depth. Once the specific depth is achieved, the tubing hanger 400 is threadedly connected to the tubing 20 at the surface. At that point, the ¼" tubing 106 and the communications line 107 are cut near the top of the derrick where the pulleys are located. Then, the remaining length of the banded ¼" tubing 106 and communication line 107 for sensors (and associated survey equipment) are pulled through the tubing hanger 400.

Compression fittings 126, 127 are connected to each of the auxiliary holes 422, 423 on the bottom of the tubing hanger 400. The ¼" tubing 106 is then inserted through the bottom end of the tubing hanger 400 in auxiliary hole 422 and the electrical wire (or, optionally, fiber optic cable) 107 is inserted through auxiliary hole 423 from the bottom of the tubing hanger 400. This procedure allows the ¼" tubing to have no splices within the wellbore 110, and the tubing hanger 400 can be tested though the test port 312 on the tubing head adapter 300 for holding pressure when completely assembled.

The tubing anchor is intended to be run into the wellbore 110 near the bottom of the tubing string 20. Below the tubing anchor, perhaps less than 100 feet, is a downhole pump (not shown). The pump is installed along the tubing string 20 in conjunction with the tubing anchor at the surface before run-in. In operation, the tubing string 20 is lowered into the wellbore 110 while keeping the proximal (or top) end of the tubing anchor still at the surface. Another section of pipe is connected to the tubing connector. From that point, a check valve (not shown) connected to the ¼" chemical injection line is banded to the joint of pipe. The tubing anchor is then threaded to a joint of tubing string 20 for run-in.

Figure 7A:
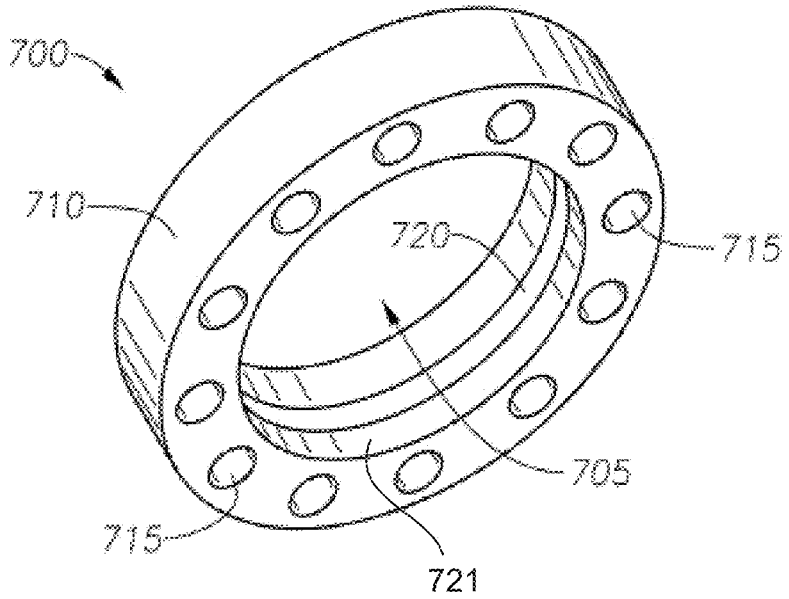
FIG. 7A is a perspective view of a rotating flange of the tubing head adapter of FIG. 2. The rotating flange is a "bottom flange," and is configured to be placed on and around the tubing head adapter. The rotating flange is used to fixedly secure the tubing head adapter to the tubing head.
Figure 7B:
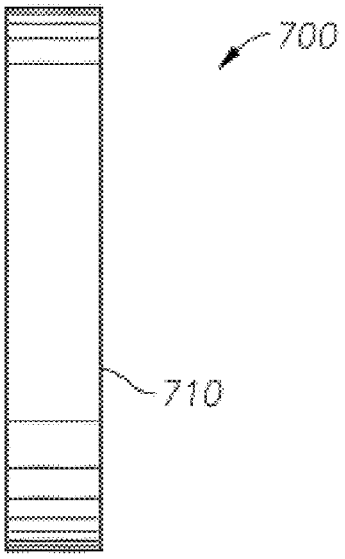
FIG. 7B is a side view of the rotating flange of FIG. 7A.

Returning to the assembly 100, the tubing hanger assembly 100 further includes a bottom rotating flange 700. FIG. 7A is a perspective view of a rotating flange 700 of the tubing head adapter 300 of FIG. 6. FIG. 7B is a side view of the rotating flange 700 of FIG. 7A.

The bottom rotating flange 700 is configured to be placed on the tubing head adapter 300, and is used to fixedly secure the tubing head adapter 300 to the tubing head 200. The rotating flange 700 defines a cylindrical body 710. The body 710 has a plurality of ports 715 formed there through. Preferably, 8 to 12 ports 715 are equi-distantly spaced around the body 710. In addition, the bottom rotating flange 700 has a bore 705 dimensioned to receive the body 310 of the tubing head adapter 300.

The bottom rotating flange 700 also includes a beveled surface 720. The beveled surface 720 is placed along an inner diameter. The beveled inner surface 720 is dimensioned to land on a matching conical surface (shown at 320 in FIG. 6) that resides along an outer diameter of the tubing head adapter 300.

Beneficially, the bottom rotating flange 700 rotates along the matching conical surface 320 of the tubing head adapter 300. This means that the matching conical surface 320 serves as a bearing surface. In this way, ports 715 drilled in the bottom flange 700 may be manually rotated to align with two or more ports (seen at 215 in FIG. 2) located along an upper shoulder (or flange) 202 of the tubing head 200 during assembly. Threaded connectors 309 may then be placed through the aligned ports 715, 215 and tightened (such as by using nuts 317) to create a sealed connection between the tubing head adapter 300 and the tubing head 200.

In order to further provide a sealed fluid connection between the tubing head adapter 300 and the tubing head 200, a seal sub 800 is provided. The seal sub 800 is shown in FIG. 2. extending up from the tubing hanger 400.

Figure 8A:
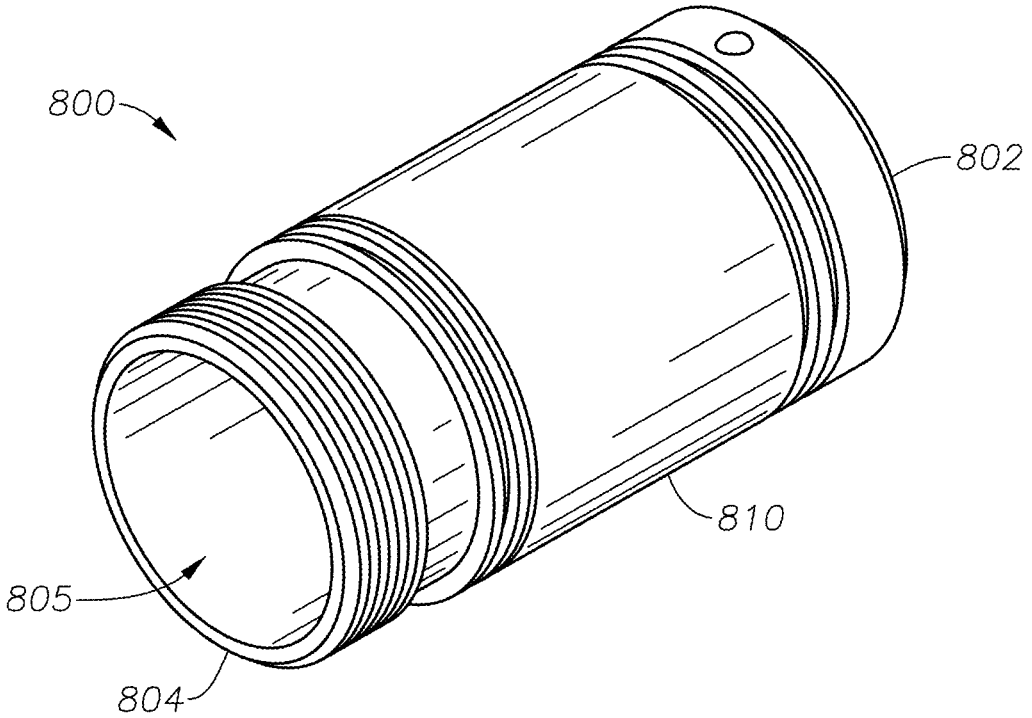
FIG. 8A is a perspective view of a seal sub of the present invention, in one embodiment. The seal sub is a cylindrical body used to provide a fluid seal between the tubing head adapter and the tubing hanger.

FIG. 8A is a perspective view of a seal sub 800 of the present invention, in one embodiment. As can be seen, the seal sub 800 defines a cylindrical body 810 having a bore 805 there through. The seal sub 800 has a top end 802 that is received in the bore 305 of the tubing head adapter 300, and a male-threaded bottom end 804 configured to be threadedly connected with the upper (box) end 402 of the tubing hanger 400.

Figure 8B:
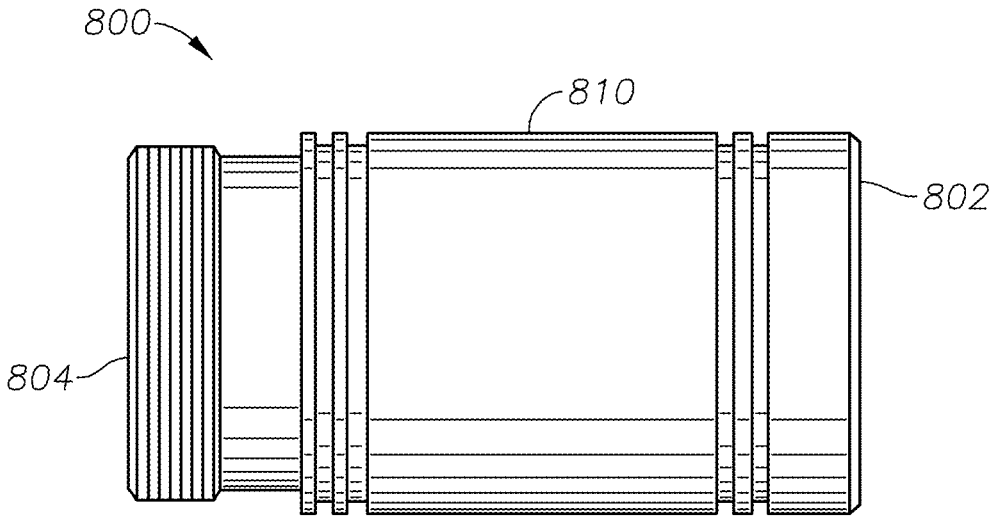
FIG. 8B is a side view of the seal sub of FIG. 8A.
Figure 8C:
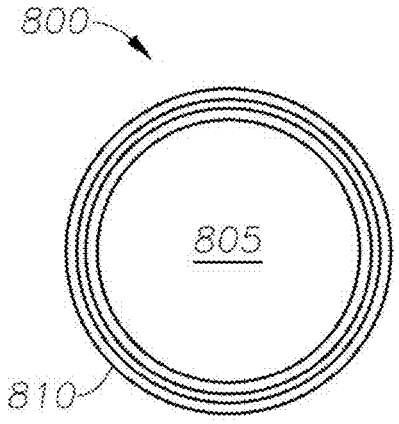
FIG. 8C is an end view of the seal sub of FIG. 8A, taken from the lower end.

FIG. 8B is a side view of the seal sub 800 of FIG. 8A, while FIG. 8C is an end view, taken from the lower end 804. Upon assembly, the bore 805 of the seal sub 800 is aligned with the bore 305 of the tubing head adapter 300 and the bore 405 of the body 410 of the tubing hanger 400. Various seals or o-rings may be placed about an outer diameter of the body 810. This serves to fluidically seal the seal sub 800 within the tubing hanger 400 and the tubing head adapter 300 at opposing ends.

As can be seen, a tubing hanger assembly 100 is provided that includes both a novel tubing head adapter 300 and a tubing hanger 400. The tubing hanger system 100 allows an operator to have access to the wellbore 110 for the purpose of injecting treatment chemicals. Treatment chemicals are injected through a chemical injection line 106 which passes through an auxiliary hole 522 in the tubing head adapter 300 and extending through the tubing hanger 400. In addition, the tubing hanger system 100 allows an operator to have access to the wellbore 110 for the purpose of monitoring well pressure and temperature by using survey equipment with communications line 107 which passes through an auxiliary hole 523 strategically placed within the tubing head adapter 300 and extending through the tubing hanger 400.

The tubing hanger 400 is suited with concentric tubing connections along with two other through openings 422, 423 that are drilled axially in reference to the wellbore 110. These through openings 422, 423 provide a route for chemicals to be passed on to sub-surface equipment (through line 106) and for electrical wires or fiber optic cable (via line 107) to deliver energy to well survey equipment and to optionally transmit readings or data signals to the surface.

In operation, once the tubing hanger 400 is in its landed position, the lock pins 211 are engaged and the seal sub 800 is inserted to connect and seal the tubing hanger 400 and the tubing head adapter 300. Before the tubing head adapter 300 is placed on top of the tubing head 200, it is assembled for installation. FIG. 3 demonstrates the bottom rotating flange 700 of the tubing head adapter 300 in place so that the conical surface 320 of the tubing head adapter 300 and the matching beveled surface 720 of the bottom rotating flange 700 engage to form a metal-to-metal seal. All bolts 309 specified for the size of the flange 700 are placed through the holes 715 of the bottom rotating flange 700 and the aligned through-openings 215 of the top flange 202 of the tubing head 200 in preparation to receive the fasteners (nuts 317) that connect the tubing head 200 and the tubing head adapter 300 together.

Compression fittings 116, 117 are connected to the top end of the auxiliary ports 522, 523 on the tubing head adapter 300. The test port 312 is plugged off until it is used for testing the holding pressure after complete installation.

As part of the wellhead, a tubing valve 25 may be placed on the top of the tubing head adapter 300. The valve 25 includes an actuator 50 for either manually or mechanically opening and closing the valve 25. The valve 25 includes upper 15 and lower 55 flanges. The upper flange 15 may be used for connecting to additional valves or a lubricator. The upper flange 15 also serves as a "lifting flange" to enable the operator to pick up the valve 25 and place it over the tubing head assembly 100. In one aspect, the lifting flange 15 is removed after the valve 25 is installed onto the tubing head assembly 100.

The lower flange 55 is used to connect to the upper end 302 (shown in FIG. 5A) of the tubing head adapter 300. Below the lower flange 55 is an upper rotating flange (called a "spin-on" flange) 900. The lower flange 55 and the upper rotating flange 900 are connected by means of a connector 909.

Figure 9A:
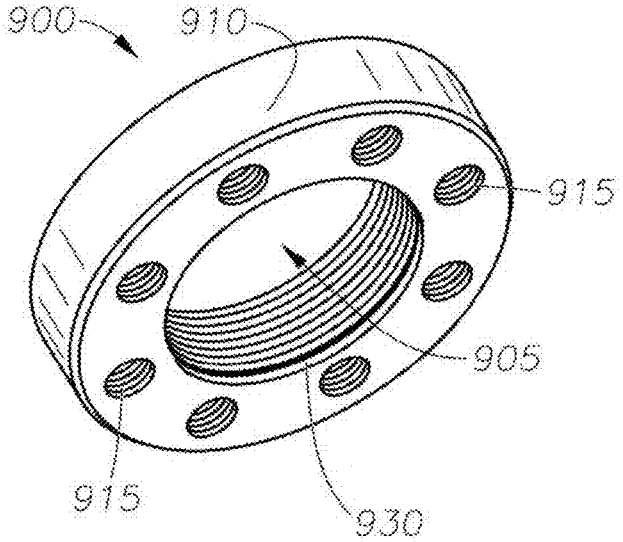
FIG. 9A is a perspective view of a spin-on flange. The spin-on flange is a threaded "upper flange," and is used to secure the upper threaded end of the tubing head adapter to an upper portion of the wellhead, or to a valve.
Figure 9B:
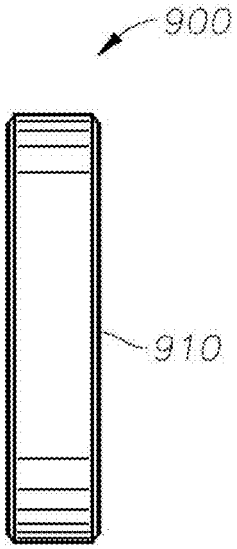
FIG. 9B is a side view of the spin-on flange of FIG. 9A.
Figure 9C:
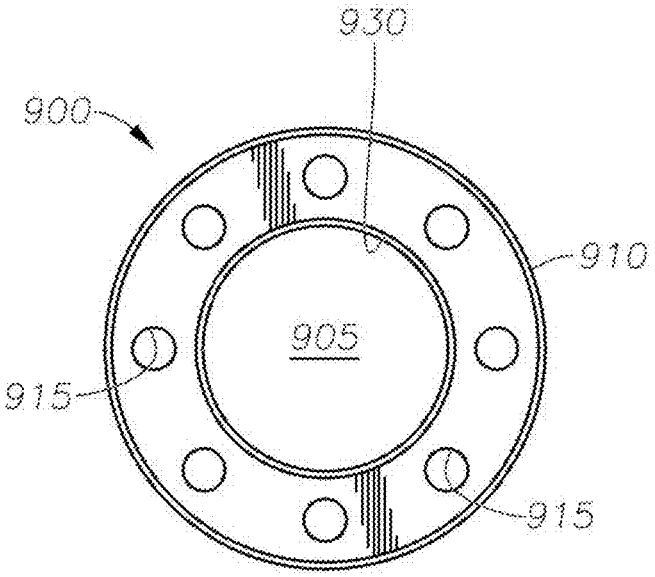
FIG. 9C is an end view of the spin-on flange of FIG. 9A, taken from a bottom end.

FIG. 9A is a perspective view of the spin-on flange 900, in one embodiment. FIG. 9B is a side view of the spin-on flange 900 of FIG. 9A, while FIG. 9C is an end view, taken for a bottom end. It can be seen that the spin-on flange 900 defines a cylindrical body 910 having a bore 905 there through. The body 910 has a threaded inner diameter. In addition, the body 910 has a plurality of ports 915 spaced equi-distantly about its radius. The ports 915 are dimensioned to receive a threaded connector 909. The threaded connector 909 comprises threads 919 which secure the lower flange 55 to the spin-on flange 900, thereby rotatingly securing the valve 25 to the tubing head adapter 300.

In one embodiment, a connection ring (or "ring bonnet" shown at 10 in FIG. 1) is provided above an end face of the threads 315 of the tubing head adapter 300. More specifically, the ring bonnet 10 is placed in ring groove 930 residing in an upper face of the spin-on flange 900. A matching ring groove is placed along an under-surface of the lower flange 55. A ring bonnet 10 then resides in aligned ring groove 930 between the under-surface of the lower flange 55 and the top of the spin-on flange 900.

Similarly, a ring bonnet 30 may be placed along ring groove 34 residing in an upper face of the upper flange 202. A matching ring groove 36 is placed along an under-surface of the tubing head adapter 300. The tubing head adapter 300 is then placed on the top of the tubing head 200 to engage the separate ring bonnet 30. Thus, a ring bonnet 30 also resides in aligned ring grooves 34, 36 between the bottom 304 of the tubing head adapter 300 and the top 202 of the tubing head 200.

During installation, the valve 25 is orientated to benefit the installer's specific requirements. Ports radially disposed about the lower flange 55 are aligned with ports radially disposed about the spin-on flange 900. Then, two or more threaded fasteners 909 of the spin-on flange 900 are placed through aligned ports and torqued accordingly to tighten the lower flange 55 onto the tubing head adapter 300. The ring bonnet 10 is secured tightly there between.

Next, the lifting flange 15 is placed on the top end of the valve 25 so that the valve 25 and connected tubing head adapter 300 can be lifted and installed on the tubing head 200. In one aspect, the valve 25 is secured to the tubing head adapter 300, with the tubing hanger 400 residing in the tubing head bore and with a ring bonnet 30 in place over the tubing head 200, before the tubing head adapter 300 is lowered onto the tubing head 200.

The ¼" (or, optionally, ⅜" or ⅝") i.d. chemical injection tubing 106 is passed though the bottom of the adapter's 300 auxiliary port 522. In addition, the electrical wire 107 for downhole survey equipment is passed through the bottom of the tubing head adapter's 300 first auxiliary port 523. Ports 715 are aligned with ports 215. The all-thread connectors 309 are then fastened using nuts 317 to bring the tubing head adapter 300 and the tubing head 200 together. In one aspect, the lifting flange 15 is then removed.

The operator finally routes the ¼" (or other size) chemical injection tubing 106 and communications line 107 used for the downhole survey equipment to their proper locations above ground. In one aspect, the communications line 107 is a data cable connected to a processor (not shown) in communication with a transceiver. In this way, data signals may be received and analyzed remotely. Optionally, a control signal may be sent by a well operator from a remote location to increase or decrease a distribution of treatment chemical through the chemical injection tubing 106.

As can be seen, an improved tubing hanger assembly 100 is provided. The tubing hanger assembly 100 provides a system of engineered parts that enable an operator to access a wellbore with a chemical injection line 106 and a communications line 107 while overcoming port alignment issues present in existing wellheads. At the same time, the tubing string 20 may be maintained in the wellbore in tension from the surface.

Using the assembly 100, the operator may monitor well activity with survey equipment. The rotating flange 700 on the body 310 of the adapter 300 enables the operator to secure the adapter 300 to the tubing head 200 with the tubing hanger 400 already in place and with the through-openings 422, 423 in the tubing hanger 400 already aligned with the auxiliary holes 522, 523 in the adapter 300.

Yet another advantage of the assembly 100 is the spin-on flange 900 on the top end of the adapter 300. With this flange 900 having rotation, it gives the freedom to place a valve 25 or other flange on top of the adapter 300 with alignment capabilities.

Embodiments of the disclosure may provide a tubing hanger assembly 100 including a tubing head adapter 300 configured to be secured to a tubing head 200 having a central bore 205 in which a tubing hanger 400 is received, such that the tubing head adapter 300 seals with the tubing head 200 around the central bore 205. The tubing head adapter 300 defines a lower radial surface (or bottom) 304 configured to engage the tubing head 200, a lower beveled (or conical) surface 320, an upper beveled surface 600, a cylindrical surface 602 that extends between the lower beveled surface 320 and the upper beveled surface 600, and an upper radial surface 604 that extends radially inward from the upper beveled surface 600. The tubing head adapter 300 further defines a first through-opening (or auxiliary hole) 523 extending from the upper beveled surface 600 to the lower radial surface 304, a second through-opening (or auxiliary hole) 522 extending from the upper beveled surface 600 to the lower radial surface 304, and a third through-opening (e.g., a central bore) 305 extending from the upper radial surface 604 to the lower radial surface 304.

The tubing hanger assembly 100 also includes a bottom flange 700 engaging the lower beveled surface 320 and configured to secure the tubing head adapter 300 to the tubing head 200 without altering alignment of the first, second, and third through-openings 523, 522, 305 of the tubing head adapter 300 and the first, second and third openings 423, 422, 405 of the tubing hanger 400. The bottom flange 700 is positionable on the tubing head adapter 300 such that the bottom flange 700 can be rotated independently of the tubing head adapter 300 so as, e.g., to maintain alignment of the first, second and third through-openings 423, 422, 405 of the tubing hanger 400 with first, second, and third through-openings 523, 522, 305 of the tubing head adapter 300, respectively.

A first line 107 may be routed through the first through-opening 423 in the tubing hanger 400 and routed through the first through-opening 523 in the tubing head adapter 300. A second line 106 may be routed through the second through-opening 422 in the tubing hanger 400 and the second through-opening 522 in the tubing head adapter. The tubing hanger 400 may be secured to the tubing string 20.

The inner surface 720 of the central bore 721 of the bottom flange 700 is configured to bear against an outer surface (e.g., the lower beveled surface 320) of the tubing head adapter 300 after the bottom flange 700 is positioned on the tubing head adapter 300. The inner surface 720 of the central bore 721 is a beveled surface shaped complementary to the lower beveled surface 320 of the tubing head adapter 300.

The first through-opening 523 of the tubing head adapter 300 is configured to receive the first (e.g. communications) line 107 therethrough. The second through-opening 522 is configured to receive the second (e.g., chemical injection) line 106 therethrough. The third through-opening 305 is configured to communicate with an interior of a production tubing 20 coupled to the tubing hanger 400, the third through-opening 305 extending through a center of the tubing head adapter 300.

The first through-opening 523 includes a first section 610 and a second section 612, the first and second sections 610, 612 intersecting at an obtuse angle 614 such that the communications line 107 received through the first through-opening 523 is bent within the tubing head adapter 300. The second through-opening 522 extends in a straight line between the bottom radial surface 304 and the upper beveled surface 600 such that the chemical injection line 106 received therethrough is not bent in the tubing head adapter 300. The third through-opening 305 extends vertically through the tubing head adapter 300 along a centerline thereof from the upper radial surface 604 to the lower radial surface 304.

At least a portion of the upper beveled surface 600 includes a first upper beveled surface 620 and a second upper beveled 622 surface that intersects the cylindrical surface 602. The first and second upper beveled surfaces 620, 622 intersect at an obtuse angle 624. The second through-opening 522 is defined in the first upper beveled surface 630 and not through the second upper beveled surface 622.

The tubing head adapter 300 further defines a shoulder 630 extending from the first beveled surface 620 at an acute angle 632 and intersecting the upper radial surface 604. The tubing head adapter 300 further defines a test port 312 extending from the upper beveled surface 622 to the third through-opening 305. The first and second through-openings 523, 522 extend at a non-zero angle to the third through-opening 305.

While it will be apparent that the inventions herein described are well calculated to achieve the benefits and advantages set forth above, it will be appreciated that the inventions are susceptible to modification, variation and change without departing from the spirit thereof

What is claimed is:

1. A tubing hanger assembly, comprising:

a tubing head adapter configured to be secured to a tubing head having a central bore in which a tubing hanger is received, such that the tubing head adapter seals with the tubing head around the central bore, the tubing head adapter defining a lower radial surface configured to engage the tubing head, a lower beveled surface, an upper beveled surface, a cylindrical surface that extends between the lower beveled surface and the upper beveled surface, and an upper radial surface that extends radially inward from the upper beveled surface, the tubing head adapter further defining a first through-opening extending from the upper beveled surface to the lower radial surface, a second through-opening extending from the upper beveled surface to the lower radial surface, and a third through-opening extending from the upper radial surface to the lower radial surface, wherein the first and second through-openings extend at a non-zero angle relative to the third through-opening; and a bottom flange engaging the lower beveled surface and configured to secure the tubing head adapter to the tubing head without altering alignment of the first, second, and third through-openings of the tubing head adapter with the tubing hanger, wherein the bottom flange is positionable on the tubing head adapter such that the bottom flange can be rotated independently of the tubing head adapter.

2. The tubing hanger assembly of claim 1, wherein the bottom flange includes a central bore dimensioned to rotatably receive a portion of the tubing head adapter.

3. The tubing hanger assembly of claim 2, wherein the central bore of the bottom flange includes an inner surface having a shape complimentary to an outer surface of the tubing head adapter.

4. The tubing hanger assembly of claim 3, wherein the inner surface of the central bore of the bottom flange is configured to bear against the outer surface of the tubing head adapter after the bottom flange is positioned on the tubing head adapter.

5. The tubing hanger assembly of claim 4, wherein the inner surface of the central bore is a beveled surface shaped complementary to the lower beveled surface of the tubing head adapter.

6. The tubing hanger assembly of claim 1, further comprising a ring configured to be received between a lower end of the tubing head adapter and the upper end of the tubing head.

7. The tubing hanger assembly of claim 6, wherein said ring is configured to be received within a groove in the lower end of the tubing head adapter and within a groove in the upper end of the tubing head.

8. The tubing hanger assembly of claim 1, further comprising a plurality of connectors configured to be received within openings located in the bottom flange and an upper flange of the tubing head for securing the bottom flange to the tubing head, thereby securing the tubing head adapter with respect to the tubing head.

9. The tubing hanger assembly of claim 1, wherein the tubing head adapter comprises a body and a neck extending upwardly away from the body, wherein the third through-opening of the tubing head adapter extends through said body and the neck and an upper end of said neck is configured to be operatively connected to a valve.

10. The tubing hanger assembly of claim 1, wherein the first through-opening is configured to receive a communications line therethrough, wherein the second through-opening is configured to receive a chemical injection line therethrough, and wherein the third through-opening is configured to communicate with an interior of a production tubing coupled to the tubing hanger, the third through-opening extending through a center of the tubing head adapter.

11. The tubing hanger assembly of claim 10, wherein at least a portion of the upper beveled surface comprises a first upper beveled surface and a second upper beveled surface that intersects the cylindrical surface, the first and second upper beveled surfaces intersecting at an obtuse angle, wherein the second through-opening is defined in the first upper beveled surface and not through the second upper beveled surface.

12. The tubing hanger assembly of claim 11, wherein the tubing head adapter further defines a shoulder extending from the first beveled surface at an acute angle and intersecting the upper radial surface.

13. The tubing hanger assembly of claim 1, wherein the tubing head adapter further defines a test port extending from the upper beveled surface to the third through-opening.

14. A method of assembling a tubing hanger assembly, comprising:

securing a tubing hanger within a tubing head, said tubing hanger comprising a first through-opening, a second through-opening, and a third through-opening, the first, second, and third through-openings extending through the tubing hanger;

positioning a tubing head adapter over the tubing hanger, said tubing head adapter comprising a first through-opening, a second through-opening, and a third through-opening, the first, second, and third through-openings extending through a portion of the tubing head adapter;

positioning a bottom flange over the tubing head adapter;

rotationally aligning the first, second, and third through-openings in the tubing head adapter with the first, second, and third through-openings in the tubing hanger; and securing the tubing head adapter with respect to the tubing hanger and tubing head by securing the bottom flange to the tubing head, without altering the alignment of the first, second, and third through-openings of the tubing head adapter and first, second, and third through-openings in the tubing hanger, wherein the tubing head has a central bore in which the tubing hanger is received, wherein the tubing head adapter seals with the tubing head around the central bore, the tubing head adapter defining a lower radial surface configured to engage the tubing head, a lower beveled surface, an upper beveled surface, a cylindrical surface that extends between the lower beveled surface and the upper beveled surface, and an upper radial surface that extends radially inward from the upper beveled surface, wherein the first through-opening in the tubing head adapter extends from the upper beveled surface to the lower radial surface, the second through-opening in the tubing head adapter extends from the upper beveled surface to the lower radial surface, and the third through-opening in the tubing head adapter extends from the upper radial surface to the lower radial surface, and wherein an inner surface of the bottom flange engages the lower beveled surface to secure the tubing head adapter to the tubing head.

15. The method of claim 14, wherein the first, second, and third through-openings in the tubing head adapter are rotationally aligned with the first, second, and third through-openings in the tubing hanger prior to positioning the bottom flange over the tubing head adapter.

16. The method of claim 14, further comprising the step of routing a line through at least one of the first, second, or third through-openings in the tubing head adapter.

17. The method of claim 16, further comprising the step of routing said line through at least one of the first, second, or third through-openings in the tubing hanger.

18. The method of claim 16, further comprising the step of securing the line to the tubing head adapter with a fitting.

19. The method of claim 14, wherein the step of securing the bottom flange to the tubing head comprises rotating the bottom flange until openings located in the bottom flange are aligned with openings in an upper flange of the tubing head, and thereafter securing the bottom flange to the tubing head using connectors inserted through the aligned openings in the bottom flange and tubing head.

20. The method of claim 14, further comprising the step of positioning a ring between a lower end of the tubing head adapter and an upper end of the tubing head.

21. The method of claim 14, further comprising the steps of securing the tubing hanger to a tubing string, and operatively connecting a valve to the tubing head adapter such that fluid communication between the valve and the tubing string is provided by the tubing head adapter and the tubing hanger.

22. The method of claim 14, further comprising the steps of:

running a tubing string into a wellbore, with a first line and a second line connected to said tubing string; and thereafter, routing the first line through the first through-opening in the tubing hanger, routing the first line through the first through-opening in the tubing head adapter, routing the second line through the second through-opening in the tubing hanger and the second through-opening in the tubing head adapter, and securing the tubing hanger to the tubing string.

23. An assembly for use with a tubing head, comprising:

a tubing head adapter configured to be secured with respect to said tubing head, the tubing head having a central bore in which a tubing hanger is received, such that the tubing head adapter seals with the tubing head around the central bore, the tubing head adapter defining a lower radial surface configured to engage the tubing head, a lower beveled surface, an upper beveled surface, a cylindrical surface that extends between the lower beveled surface and the upper beveled surface, and an upper radial surface that extends radially inward from the upper beveled surface, the tubing head adapter further defining a first through-opening extending from the upper beveled surface to the lower radial surface, a second through-opening extending from the upper beveled surface to the lower radial surface, and a third through-opening extending from the upper radial surface to the lower radial surface; and a bottom flange engaging the lower beveled surface and configured to secure the tubing head adapter to the tubing head, the bottom flange having a central bore dimensioned to rotatably receive a portion of the tubing head adapter, wherein the bottom flange is positionable on the tubing head adapter such that the bottom flange can be rotated independently of the tubing head adapter so as to maintain alignment of first, second and third through-openings of the tubing hanger with the first, second, and third openings of the tubing head adapter, respectively.

24. The assembly of claim 23, wherein the central bore of the bottom flange includes an inner surface having a shape complimentary to an outer surface of the tubing head adapter.

25. The assembly of claim 24, wherein the inner surface of the central bore is configured to bear against the outer surface of the tubing head adapter after the bottom flange is positioned on the tubing head adapter.

26. The assembly of claim 24, wherein the inner surface of the central bore is a beveled surface and the outer surface of the tubing head adapter is a conical surface.

27. The assembly of claim 23, wherein the tubing head adapter includes a central bore that is configured to be aligned with a central bore of the tubing head.

28. A tubing hanger assembly, comprising:

a tubing head adapter configured to be secured to a tubing head having a central bore in which a tubing hanger is received, such that the tubing head adapter seals with the tubing head around the central bore, the tubing head adapter defining a lower radial surface configured to engage the tubing head, a lower beveled surface, an upper beveled surface, a cylindrical surface that extends between the lower beveled surface and the upper beveled surface, and an upper radial surface that extends radially inward from the upper beveled surface, the tubing head adapter further defining a first through-opening extending from the upper beveled surface to the lower radial surface, a second through-opening extending from the upper beveled surface to the lower radial surface, and a third through-opening extending from the upper radial surface to the lower radial surface; and a bottom flange engaging the lower beveled surface and configured to secure the tubing head adapter to the tubing head without altering alignment of the first, second, and third through-openings of the tubing head adapter with the tubing hanger, wherein the bottom flange is positionable on the tubing head adapter such that the bottom flange can be rotated independently of the tubing head adapter, wherein the first through-opening is configured to receive a communications line therethrough, wherein the second through-opening is configured to receive a chemical injection line therethrough, and wherein the third through-opening is configured to communicate with an interior of a production tubing coupled to the tubing hanger, the third through-opening extending through a center of the tubing head adapter, and wherein the first through-opening comprises a first section and a second section, the first and second sections intersecting at an obtuse angle such that the communications line is bent within the tubing head adapter, wherein the second through-opening extends in a straight line between the bottom radial surface and the upper beveled surface such that the chemical injection line is not bent in the tubing head adapter, and wherein the third through-opening extends vertically through the tubing head adapter along a centerline thereof from the upper radial surface to the lower radial surface.

* * * * *